US008339062B2

(12) United States Patent
Cencur

(10) Patent No.: US 8,339,062 B2
(45) Date of Patent: Dec. 25, 2012

(54) METHOD FOR DIMMING NON-LINEAR LOADS USING AN AC PHASE CONTROL SCHEME AND A UNIVERSAL DIMMER USING THE METHOD

(76) Inventor: Marko Cencur, New York, NY (US)

( * ) Notice: Subject to any disclaimer, the term of this patent is extended or adjusted under 35 U.S.C. 154(b) by 577 days.

(21) Appl. No.: 12/466,131

(22) Filed: May 14, 2009

(65) Prior Publication Data

US 2009/0284182 A1 Nov. 19, 2009

Related U.S. Application Data

(60) Provisional application No. 61/053,497, filed on May 15, 2008.

(51) Int. Cl.
*H05B 37/02* (2006.01)

(52) U.S. Cl. ..... 315/291; 315/194; 315/308

(58) Field of Classification Search ..... 315/307, 315/224, 291, 194, 197–199, 225, 287, 300, 315/302, 308; 323/237; 307/252
See application file for complete search history.

(56) References Cited

U.S. PATENT DOCUMENTS 5,041,763 A * 8/1991 Sullivan et al. ..... 315/176
7,902,769 B2 * 3/2011 Shteynberg et al. ..... 315/291
2005/0168168 A1 * 8/2005 Elliott ..... 315/247
2005/0275354 A1 * 12/2005 Hausman et al. ..... 315/291
2008/0273125 A1 * 11/2008 Nishinosono ..... 348/790

FOREIGN PATENT DOCUMENTS

JP 01-166496 A 6/1989
JP 01-294399 A 11/1989
JP 2005 259454 A 9/2005

* cited by examiner

*Primary Examiner* — Jacob Y Choi
*Assistant Examiner* — Henry Luong
(74) *Attorney, Agent, or Firm* — William J. Sapone; Coleman Sudol Sapone P.C.

(57) ABSTRACT

A universal dimmer has a switching element, a load current measurement element, a current evaluator for evaluating the current passing through the load, and a firing angle adjuster such as a regulator or transforming element. The current passing through the load is measured and evaluated so as to direct the firing angle adjuster to adapt firing angles of the switching element so that a load RMS current is proportional to a dimmer input signal, regardless of the type of load being controlled. The universal dimmer is capable of dimming the output from linear and non-linear loads using AC power line phase angle control to vary output power of linear and non-linear loads, ranging from regular linear loads such as incandescent lamps, to non-linear loads, such as LED lamps, compact fluorescent lights (CFLs'), etc. as well as linear loads with large phase shift, that is, inductive and capacitive loads.

19 Claims, 9 Drawing Sheets

METHOD FOR DIMMING NON-LINEAR LOADS USING AN AC PHASE CONTROL SCHEME AND A UNIVERSAL DIMMER USING THE METHOD

CROSS REFERENCE TO RELATED APPLICATIONS

This application claims priority in U.S. Provisional patent Application No. 61/053,497 filed May 15, 2008.

TECHNICAL FIELD

This invention relates to a method for altering the output from non-linear loads, such as for dimming the light emitted by light emitting diodes (LED's), and more particularly, to a method for dimming non-linear loads using an alternating current (AC) phase control method.

BACKGROUND

Traditional line voltage dimmers use phase angle control to control the amount of power delivered to a load. The line voltage dimmer chops the alternating current line voltage period and delivers power to the load only for a fraction of the period. The longer the dimmer conducts the current, the larger is the amount of power supplied to the load. Different methods can be used to deliver power to the load. One method uses standard phase control, where the load is connected to the line voltage at a certain point or a certain angle in the AC period and remains connected until the next zero pass. In this case, the current doesn't flow to the load until the desired AC phase angle is reached, as illustrated in FIG. 1*a*. This method is sometimes referred as a "leading edge dimmer". Another method uses reverse phase control. The load is connected to the line voltage from the beginning of the AC period (zero angle) and is switched off at a certain point in the AC period. The current therefore flows from the zero angle until the desired angle is reached and the current is then switched off, as illustrated in FIG. 1*b*. This method is sometimes referred as a "trailing edge dimmer".

Conventional dimmers are built to control linear loads. Linear loads are loads that draw sinusoidal current corresponding to the applied sinusoidal voltage as shown on FIG. 2*a*. Conventional dimmers are built to control linear loads with either no phase shift or a small phase shift between the applied voltage and the load current. FIG. 2*a* depicts a linear load without phase shift. Such loads may be, for example, incandescent lamps or halogen lamps, even if they are powered through low voltage magnetic transformers.

LED lamps, CFL lamps, electronic low voltage transformers and similar devices are examples of non-linear loads, where the current does not correspond to the sinusoidal input voltage, as shown on FIG. 2*b*.

The difficulty in dimming non-linear loads is illustrated in FIG. 3. First, looking at how a linear-load is dimmed, as illustrated in FIG. 3*a*, notice that the load current corresponds nicely to the dimmer output voltage. When the dimmer "clips" the voltage, load current corresponds to the clipped voltage. When the voltage is reduced, the current is reduced accordingly. The power output is indicated in terms of % to indicate an approximation of the output for different dimming levels. The indicated power levels are approximations to show the principle of operation and are not precise values.

Dimming with conventional dimmers is possible because the current is predictable and it corresponds to the chopped voltage. If the AC period is chopped at the predetermined levels, the power delivered to the load is also correspondingly predetermined.

FIG. 3*b* shows the dimming of a non-linear load. With a non-linear load, the current does not correspond to the voltage in a predetermined and predictable way. In FIG. 3*b*, if the input voltage is reduced by clipping, the current does not change for some time, then it quickly drops to zero and again the current does not change in correspondence with the following dimming steps.

The output characteristic for a linear load is shown in FIG. 4*a*, the output characteristics for a non-linear load shown in FIG. 4*b*. The output characteristic for the non-linear load clearly shows that setting the output to a desired level for such a load would be quite difficult, since most of the input variation does not produce any output change. Only a very limited input range actually results in a change in output. Consequently, very small changes in input in this range make very dramatical output changes, making this control overly sensitive and completely impractical. Even worse, each non-linear load can have a completely different characteristic, and the current spike can even fall outside the control range of a conventional dimmer. This example is shown in FIG. 5, where changing the input across the whole range does not produce any significant change in output.

For some non linear loads, the current characteristic changes depending on the applied voltage. If a chopped voltage is applied to such load, the current spike shape and position can unpredictably change, depending on the amount of the chopped voltage applied. This makes the load current even more unpredictable and harder to control with conventional dimmers.

Consequently, attempting to control the power output for most non-linear loads, using a conventional dimmer is difficult to impossible.

Dimmers suffering from the above described problems include the conventional standard phase control dimmers described in U.S. Pat. Nos. 3,684,919 or 3,397,344, and the reverse phase control dimmers described in U.S. Pat. Nos. 4,528,494 or 5,038,081.

One approach to this problem is to modify the non-linear load itself, for use with a conventional dimmer. This generally involves designing the non-linear load to display load characteristics that mimic linear loads. Special circuits or circuit designs need to be incorporated into the non-linear load for this to work, increasing the cost, complexity and size of the load. Examples of such modified loads include dimmable electronic low voltage transformers, dimmable LED's, dimmable CFL's, etc., U.S. Pat. No. 6,172,466 being an example.

While dimming of such devices with conventional dimmers is possible, including special circuits inside the non-linear loads makes them more complex and expensive. This method does not change the ability of the dimmer to regulate power of the non-linear load, but rather attempts to make non-linear load linear.

Another approach is to incorporate a dedicated power controller with the non-linear load. The controller can be built into the load or be a separate unit wired to the load, so that the load can be accessed and controlled via dedicated wires, or via signals superimposed on power lines or another similar method. This solution is also expensive since special circuits and in some cases special wiring is needed. Examples of such designs are described in U.S. Pat. No. 7,358,679, In U.S. Pat. Nos. 4,350,935, 4,527,099 and 4,728,866, various methods of regulating power of inductive loads (such as HID and fluorescent lamps with magnetic ballasts) are described which utilize a modified phase control method.

This method is useful for linear loads with large phase shift between current and voltage and would work on linear inductive loads, or even possibly on resistive and capacitive linear loads, but would not be useful for non-linear loads since the method assumes the load current will follow the chopped AC voltage in a predictable way, which is not the case with non-linear loads.

Another approach could be to reduce the AC voltage while retaining the sinusoidal form via some sort of PWM, as described for example in U.S. Pat. No. 5,691,628. This method may be able to control power of most linear and non-linear loads, but the component count and complexity of such a circuit makes it very expensive to implement. Furthermore, the higher switching frequencies used in such circuits produce more switching loses, making it less efficient.

SUMMARY OF THE INVENTION

It is an object of the present invention to provide a universal dimmer that provides a variable power delivery method using AC power line phase angle control to vary output power of linear and non-linear loads, ranging from regular linear loads such as incandescent lamps, to non-linear loads, such as LED lamps, CFLs etc. as well as linear loads with large phase shift, that is, inductive and capacitive loads.

Such a universal dimmer is achieved by using a method that measures and evaluates parameters of the load current and adapts the firing angles of the switching element in such way that the load RMS current is proportional to the dimmer setting (input), regardless of the type of load being controlled.

DETAILED DESCRIPTION OF THE INVENTION

To provide a dimmer that can effectively vary the power delivered to a non-linear load, the characteristic of the load must be determined. To achieve this, the load current must be measured and analyzed. Also, to effectively regulate the output, it is important that a dimmer have the ability to switch the power to the load on and off at arbitrary angles in the AC period. Thus, the dimmer should be capable of connecting and disconnecting the power even at negative phase angles, that is, before zero crossing.

Figure 6:
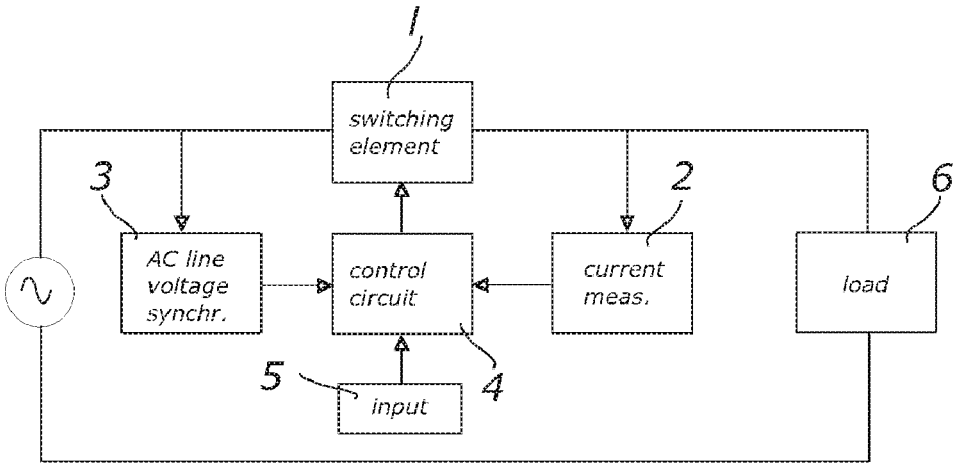
FIG. 6 is a block diagram of the power control method of the present invention.

A dimmer according to the present invention would achieve these results, following the basic building blocks illustrating the method as shown in FIG. 6.

A switching element 1 switches on or off the power delivered to the load. Since the switching element should be able to open and close at arbitrary points in AC period, a transistor is preferably used. A regular triac should not be used as a regular triac cannot be switched off at will once it is triggered. Special versions of a triac (such as GTO triac) could be used.

Figure 1:
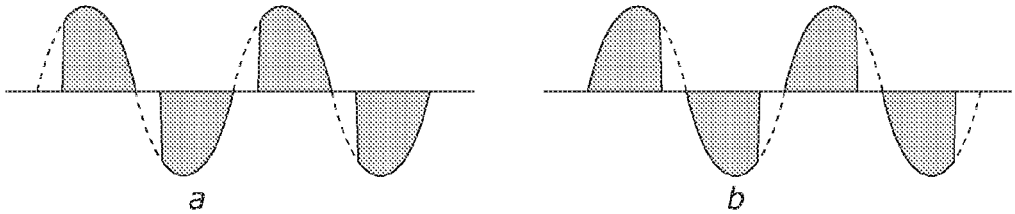
Fig. 1 PRIOR ART
FIG. 1*a* depicts a typical output waveform of a standard phase control dimmer.
FIG. 1*b* depicts a typical output waveform of a reverse phase control dimmer.
Figure 2:
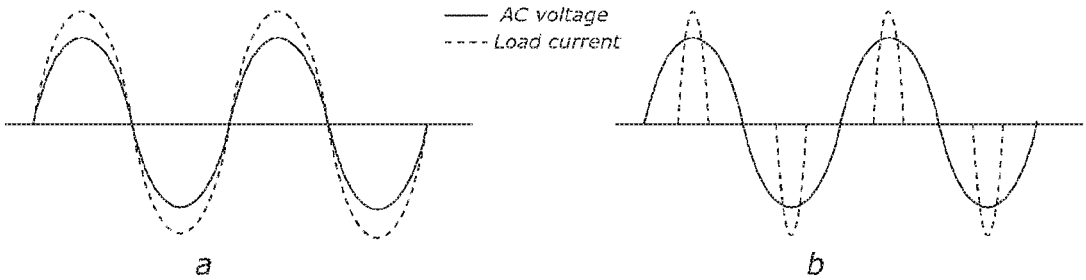
Fig. 2 PRIOR ART
FIG. 2*a* depicts a linear load current without a phase shift.
FIG. 2*b* depicts a non-linear load current.
Figure 3:
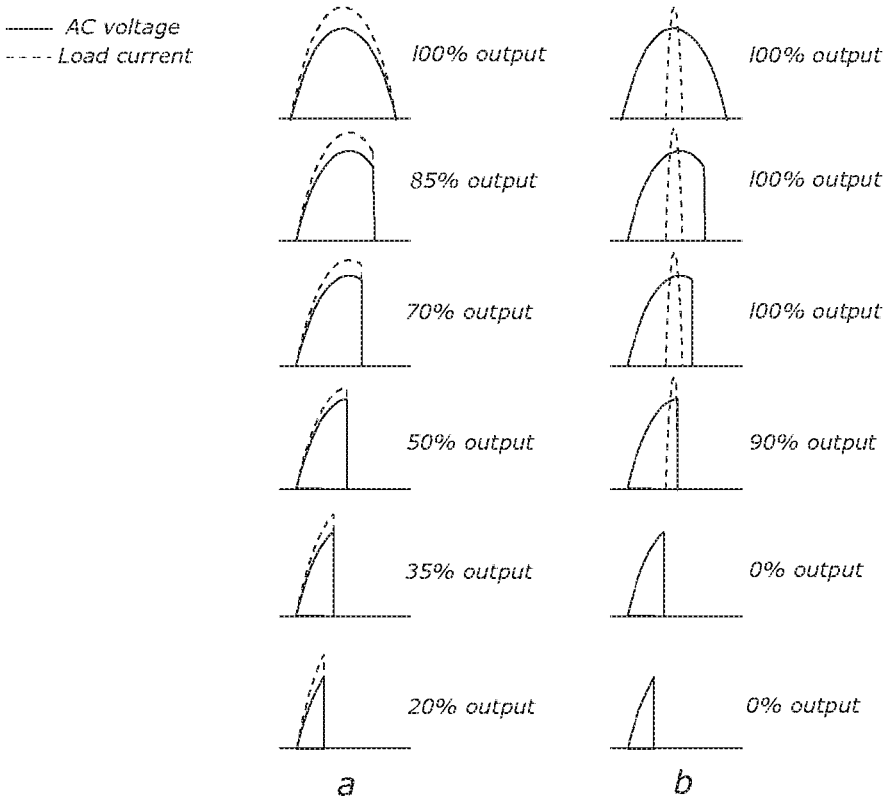
Fig. 3 PRIOR ART
FIG. 3*a* depicts dimming of a linear resistive load with a conventional reverse phase dimmer.
FIG. 3*b* depicts dimming of a non-linear load with a conventional reverse phase dimmer.
Figure 4:
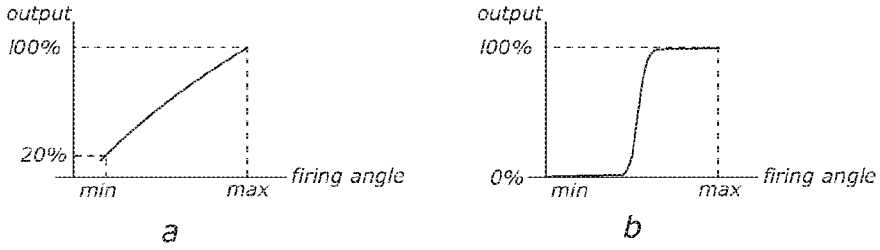
Fig. 4 PRIOR ART
FIG. 4*a* depicts an input/output relation when dimming a linear resistive load with a conventional reverse phase dimmer.
FIG. 4*b* depicts an input/output relation when dimming a non-linear load with a conventional reverse phase dimmer.
Figure 5:
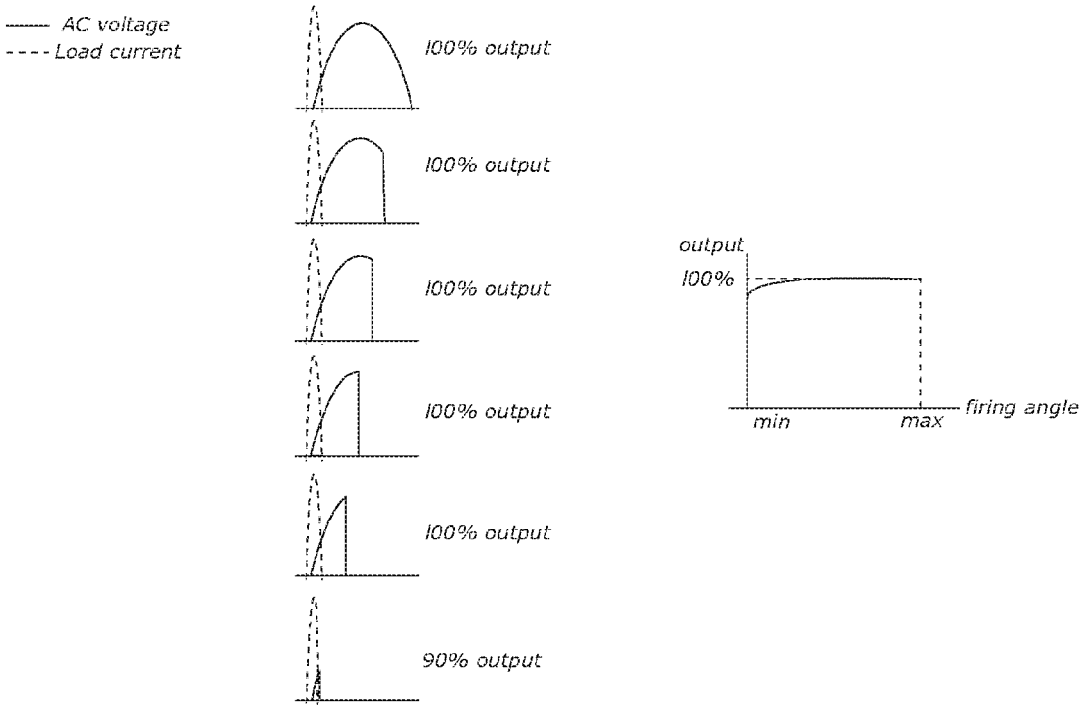
Fig. 5 PRIOR ART
FIG. 5 depicts dimming a non-linear load with a current spike outside a conventional dimmer control range and the corresponding input/output relation.

A current measuring element 2 illustrated by the current measurement block, measures the current that flows through the load, though the element can also perform signal conditioning and signal transformation as well. The element 2 then passes the measured values to a control circuit 4. The control circuit 4 performs an evaluation of the measured load current waveform and of an input value 5, and generates control signals which are transmitted to the switching element 1, to effect the switching of the power on and off in synchronization with an AC period. The Input 5 can be any possible control signal that is used to set the desired power output, such as manually operated twist knobs, capacitive sensors, PIR sensors, sound sensors, light or any other sensors, control voltages, IR or other wireless control commands. The control circuit generates signals that determine at which phase angle in the AC period the load is connected to the AC voltage and at which phase angle the load is disconnected from the voltage, which is different from conventional dimmers, which usually vary only one phase angle, or standard phase control dimmers which vary the angle at which the power is connected to the load, but leave the angle at which the power is switched off constantly at 0 degrees (see FIG. 1*a*) or reverse phase control dimmers which vary the angle at which the power is switched off, but the angle at which the power is switched on is constantly at 0 degrees (FIG. 1*b*).

The control circuit includes a firing angle adapting element such as a regulator or transforming element, where the measured load and the evaluated parameters of the load current, from the control circuit direct the firing angle adjustment element to adapt firing angles of the switching element in such way that the load RMS current is proportional to an input signal, regardless of the type of load being controlled. When the firing angle adjustment element is the transforming element 28, this can be used to transform the input values to corresponding firing angles directly, based on a measured load current time distribution.

The inventive dimmer thus is unique in that it incorporates a method for regulating and changing both the on angle and the off angle. Consequently, while various non-linear loads may have different characteristic in the positive and negative half wave of the AC period, the inventive dimmer compensates by using different sets of on/off angles for the positive and negative half period, as illustrated in FIG. 7, and labeled t1-t4.

The control circuit 4 determines the triggering angles t1-t4 in such way that the RMS current through the load is constant for a specific input value 5. Furthermore, the control circuit 4 determines the triggering angles t1-t4 in such way that for each input value 5 there is a RMS load current value which corresponds to the input value 5 in a predetermined way. As a consequence, the RMS load current follows the input value 5, i.e., the power setting selected by the user. FIG. 7 shows the switching waveforms for different input settings 5, the control circuit determining the range in which the load current is active and then calculating the on and off angles for both half periods. For example, the "On" angle for the first half period is noted as t1, the "off" for the first half period is noted t2, the "on" for the second half period is t3, and the "off" for the second half period is t4.

Figure 7:
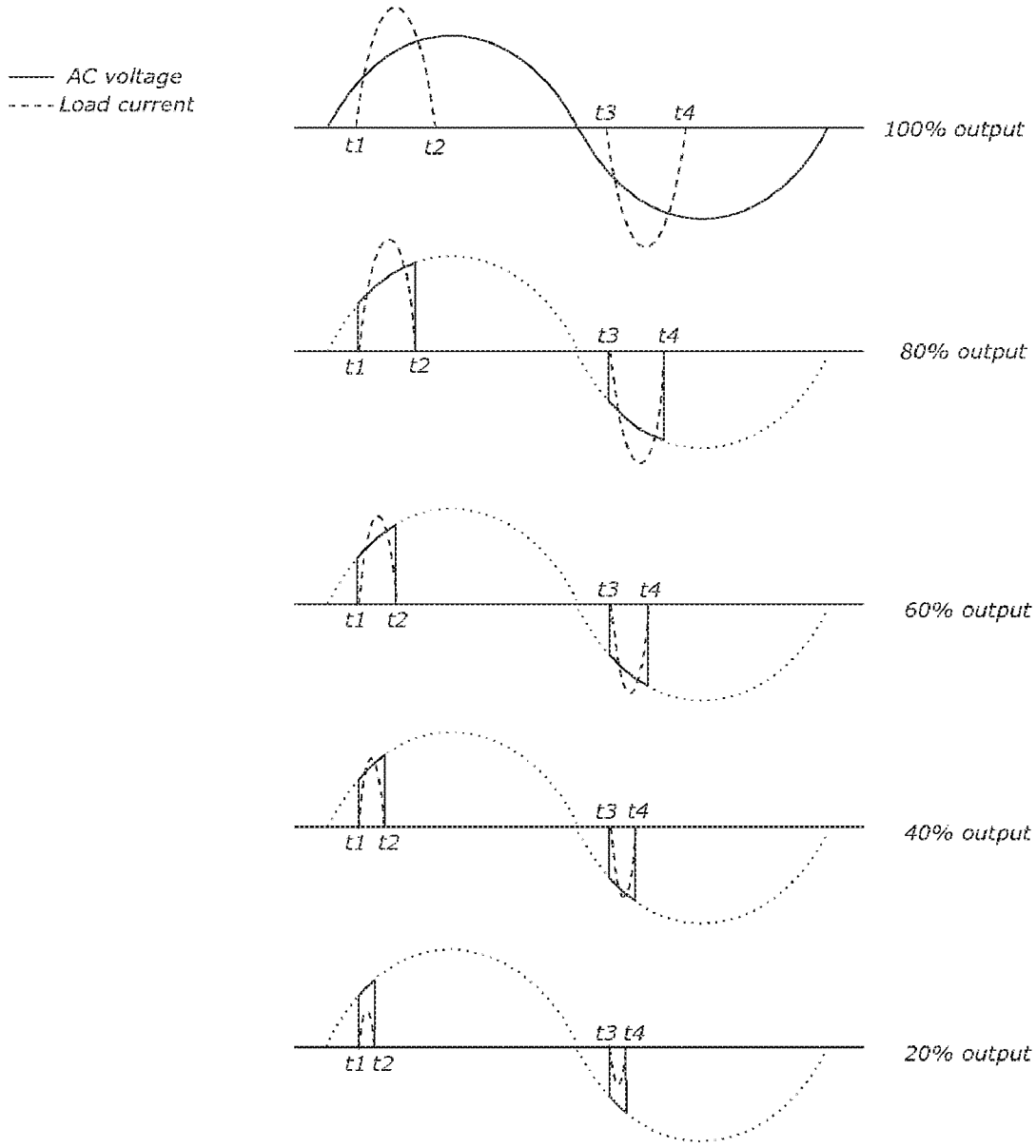
FIG. 7 illustrates waveforms for dimming a non-linear load using the inventive method at various input settings.

If the input 5 is set to a lower value, that is, for example, the user wishes to dim the output from an LED light, the control circuit 4 narrows the t1-t2 and t3-t4 intervals, reducing the load current as shown on FIG. 7, with the intervals reduced until the measured RMS load current reaches a level which corresponds to the selected lower input setting. This control circuit consequently makes the load current predictable and controllable, regardless of what load is connected, so that the power delivered to the load is controlled in a predictable fashion. The power delivered to the load is proportional to the input setting, regardless of whether the load is a linear or non-linear load.

By measuring load current, the dimmer of the present invention is adapted to work with different loads, both linear and non-linear, without any modifications of the load or modifications of the dimmer itself, so that a universal dimmer is achieved. Whatever the load characteristics may be, the t1-t4 angles will change accordingly, with the dimmer also adaptable to loads with large phase shift between current and voltage.

The inventive dimmer, using this method, can be used to control the power delivered to vastly different loads, ranging from resistive (incandescent and halogen lamps), non-linear (LED lamps, CFL lamps, non-dimmable low voltage transformers) to inductive (motors, fans). Because the switching is done at line frequency, there are no high frequency switching losses, making this dimmer more efficient, more compact and less costly than high frequency switching methods.

The control circuit can be programmed into a microprocessor, CPU or other similar high-integration chip or can also be manufactured from discrete component parts or a combination of both. The programmable processor offers of course more flexibility in programming various input/output characteristics. This is desirable because many loads do not exhibit a linear relationship between current and output. To achieve the most uniform output relative to an input setting, it may be desirable to program a corrective curve into a processing unit specifically for such a load.

Also, different loads may have different current to output characteristics. For example, the relationship between motor rotation speed and motor current can be quite different than the relationship between LED brightness and LED current. A programmable processing unit can be pre-programmed to recognize different load types from load current characteristics and then to automatically select the appropriate corrective curve to use to give the most uniform output.

Many different methods for calculating the t1-t4 control angles from the load current are possible. The most basic one is to measure a complete load current waveform and covert the waveform to a digital signal for the control circuit to evaluate. The sampling frequency should be high enough to capture all details contained in the signal. From the digital signal, the control circuit 4 calculates the RMS value needed to calculate the t1 . . . t4 control angle signals.

Figure 8:
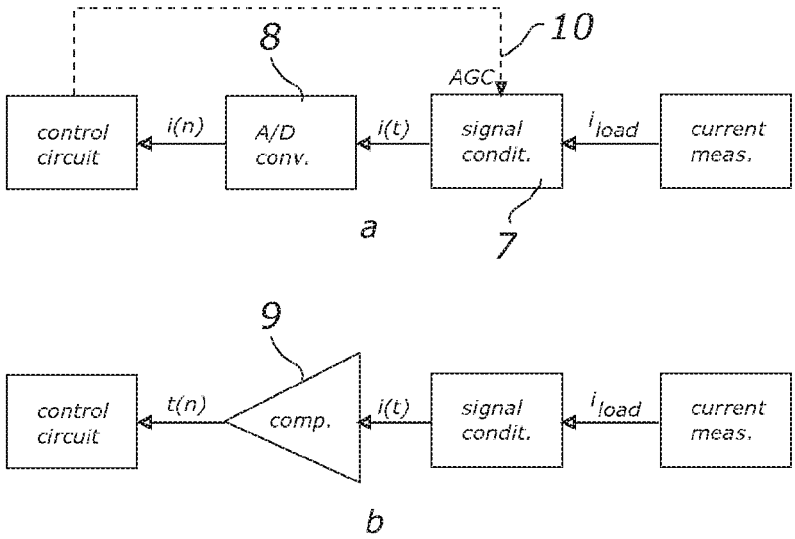
FIG. 8*a* illustrates the measure of a load current in more detail.
FIG. 8*b* is a simplified version of the measuring of the load current; and, FIG. 9 illustrates signals transmitted within the load current measurement block.

FIG. 8*a* illustrates a more detailed path for the measured current signal. The measurement block element transforms the load current signal to a corresponding voltage signal to be processed, marked "$i_{load}$". The signal conditioner, illustrated by the block 8, performs one or more of filtering, amplification, and full wave rectification. The signal conditioner could also receive control signals from the control circuit to adjust the gain 10. The resulting conditioned signal, marked i(t), is then passed to an A/D converter, and converted to a series of samples i(n) which are to be evaluated by the control circuit. The control circuit calculates an RMS value for the load current and based on that value, and the current waveform shape, calculates the appropriate firing angles t1-t4.

A simplified version of the dimmer could be programmed to assume that the load behaves equally in both half periods. The processing unit would then calculate angles for the first half period t1 and t2, with values for the second period assumed to be the same as the values calculated for the first half period, making t3 equal to t1 and t4 equal to t2. In this case, the signal conditioner would only need to perform half wave rectification, simplifying the circuit.

Figure 9:
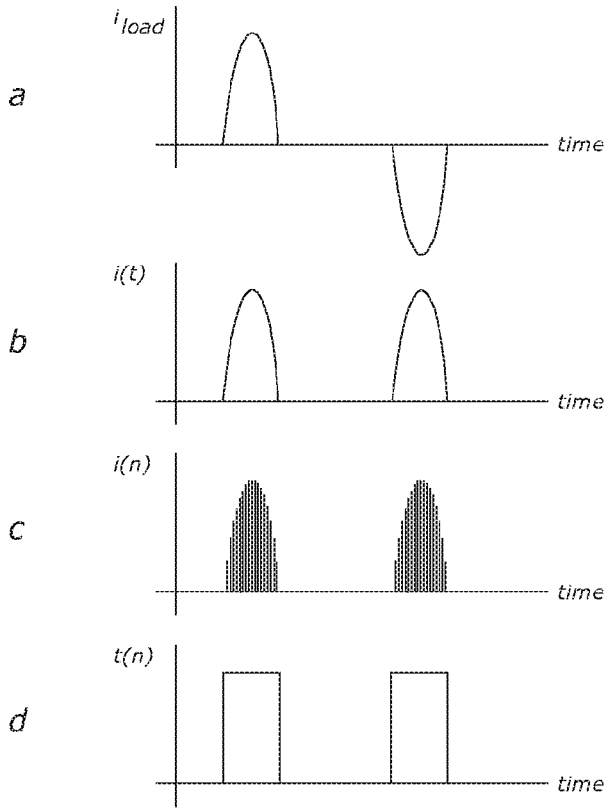

Another simplification of the dimmer is illustrated in FIG. 8*b*. The signal i(t) is fed to a comparator (9) that compares the signal to a near zero value. The comparator output is logical "1" when the current is non-zero and "0" otherwise, so that the comparator output is a digital signal, corresponding to the position and the duration of the load current. The example signal t(n) is shown in FIG. 9*d*. While information on the RMS value of the current is lost with this transformation, the information on the load current distribution within each half period is still contained in the signal t(n), and the control circuit uses this information to estimate the range for t1-t4 values. The maximum interval for t1-t4 is obtained by performing a measurement with the load switched fully "on". The duration and position of the t(n) pulse determines the maximum interval size and position for the t1-t4 values. All intermediate values for achieving lower output settings could be estimated as a reduction of the measured maximum interval.

While this control circuit would not be as precise as the earlier described methods, it would significantly reduce the circuitry, simplifying the control circuit. Further simplification is possible if it were assumed that the load behaves equally in both half periods, so that the same values would be used for t1 and t3 and also t2 would be assumed equal to t4.

Figure 10:
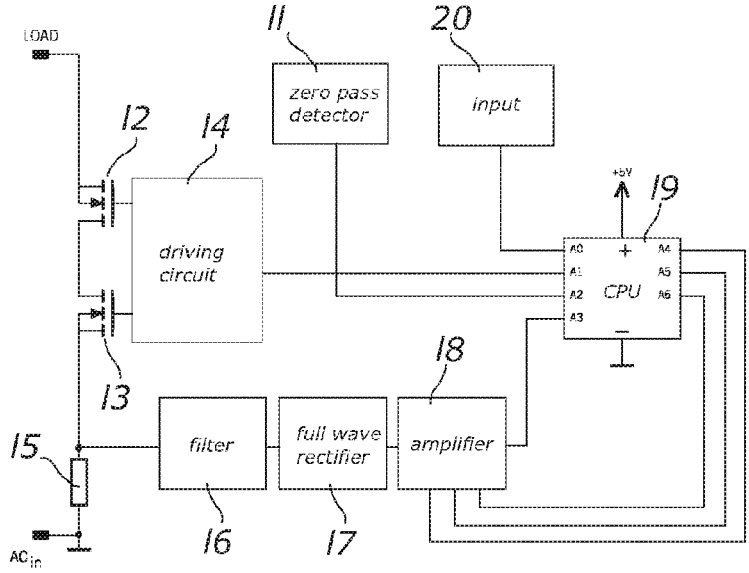
FIG. 10 illustrates another embodiment of the invention where load switching is done using FET transistors.

Another embodiment of the invention is illustrated in FIG. 10. In this embodiment, the load switching is done with using FET transistors 12 and 13, though other elements could also be used, such as IGBT. A driving circuit 14 generates appropriate transistor gate signals based on signals from processing unit 19. Synchronization with the AC period is achieved with a AC zero pass detector 11. The input 20 could be mechanical input (knob, slider, etc.), or any kind of sensor output or any kind of digital signal from any remote control unit. Many input signals are possible and the invention is not limited to any particular input type.

The load current is converted to voltage via a resistor 15 connected in series with the load. The current can be measured in many different ways, for example with a Hall sensor, transformer and the like. Again, the invention is not limited to any specific current measurement method or device.

The signal passes through a filter 16 to remove any spikes, noise and high frequencies contained in the signal which could introduce errors into the A/D conversion. The signal is processed by a rectifier 17 and an amplifier 18. The amplification can be adjusted by the processing unit 19 to obtain an optimal signal strength. The load current magnitude can vary considerably from load to load, and so the signal should be amplified in such way that it is large enough to utilize as many bits of A/D conversion as possible but not so large as to be distorted. In the embodiment depicted in FIG. 10, the processing unit controls the amount of amplification via three digital lines, A4, A5, A6, for eight possible amplification levels. More or less lines can be used, depending on the range of possible load currents. In an alternate embodiment, an automatic gain control (AGC) may be included in the amplifier itself, saving three data lines, but increasing component count. The filter 16, rectifier 17, and amplifier 18 have as their common task the conditioning of the signal for optimal A/D conversion.

Some elements can be integrated together, for example the filter and amplifier. The sequence may also differ. It should be understood that many different topologies are possible for this task and are known in the art and the invention is not limited to the one embodiment described in FIG. 10.

The processing unit receives the analog current signal on the pin A3 and the A/D converter converts the signal to a stream of digital values. The input 20 is connected to the pin A0 of the processing unit 19. The input can be an analog signal, such as from a variable resistor for example, or digital data received from a remote controller, the input signal (20) determining the amount of power that should be delivered to the load.

Figure 11:
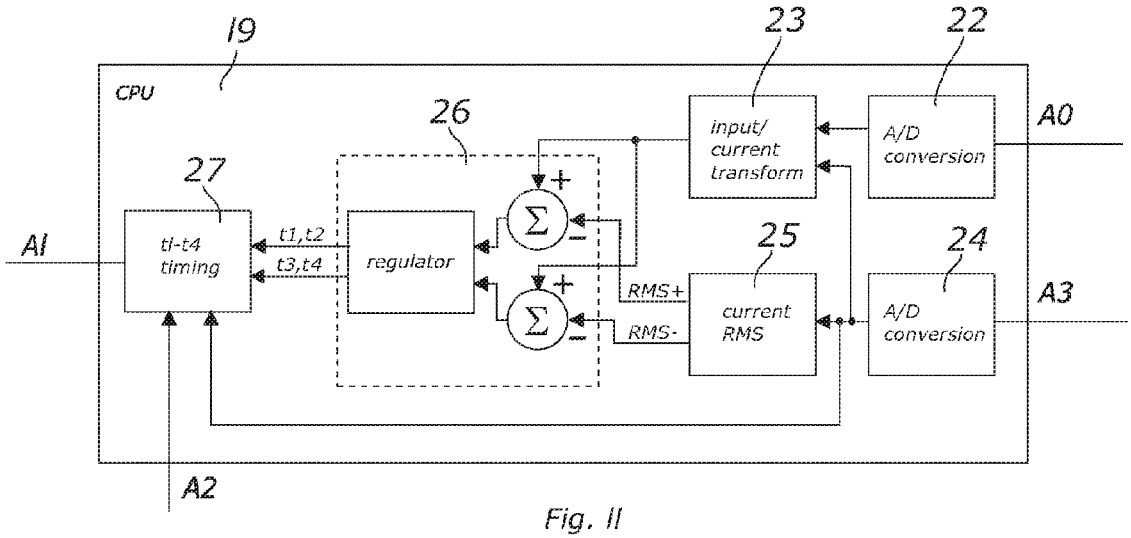
FIG. 11 is a detailed illustration of a processing unit usable with the present invention.

A detailed description of a processing unit usable with the present invention is illustrated in FIG. 11. A load current signal is connected to pin A3, with the signal (si) converted to a stream of digital values in an A/D converter 24. The current RMS value for both half periods, marked RMS+ and RMS−, are calculated at calculator 25 and the values fed to a regulator 26.

An input signal is connected to pin A0. If the signal is analog, it is converted to a digital value in the A/D converter 22. If the input signal is digital, the AD converter 22 can be omitted or by-passed. The digital input value is then processed by a transforming element 23, to be transformed so as to correspond with the desired load levels. In other words, each input value is assigned a value that corresponds to a desired load current for that particular input value. This transformation can also incorporate various corrective curves. The input transforming block 23 can analyze the load current waveform to decide which corrective curve to use.

The transformed input value and load RMS current values are fed to the regulator 26. The transformed input value, block 23 output, acts as a reference for the regulator. Based on a difference between the reference and measured RMS currents, the regulator outputs interval widths for both AC half periods (marked t1,t2 and t3,t4 on FIG. 11). Firing angles t1, t2, t3 and t4 are calculated based on the regulator output and the AC period timing. The AC timing is obtained from the AC zero pass detector connected to pin A2.

Figure 12:
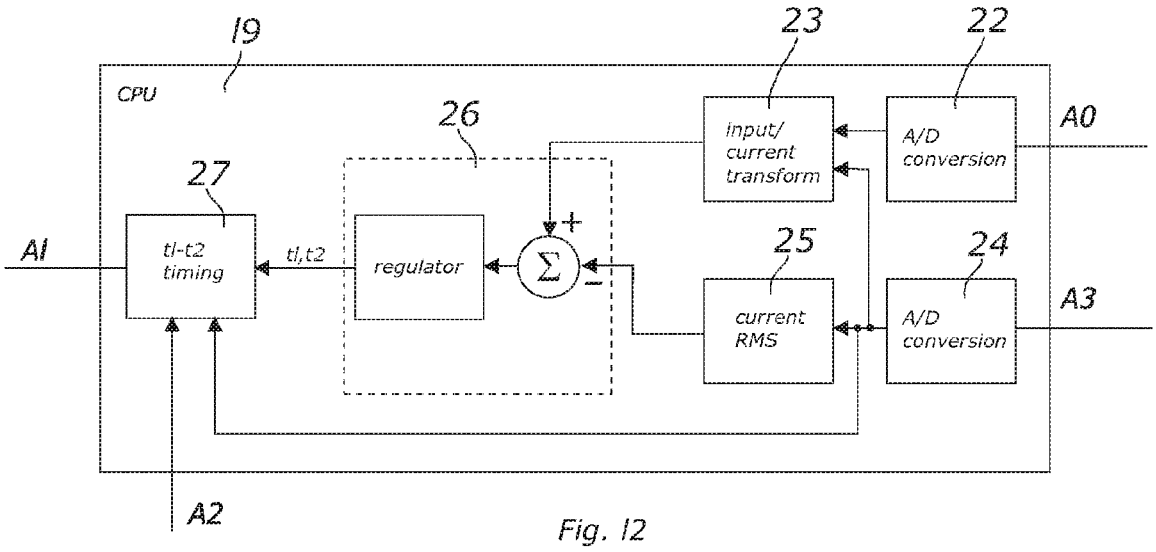
FIG. 12 is a simplified circuit and processing algorithm, usable if symmetry between both half periods is assumed.

If symmetry between both half periods is assumed, the circuit and the processing algorithm can be simplified, as illustrated in FIG. 12. In this simplification, the RMS calculation block 25 outputs only one RMS value per period. The regulator 26 in turn outputs only the t1,t2 interval width. The timing block uses the t1 and t2 values to calculate and assume the same firing angles for both half periods of the AC cycle.

Figure 13:
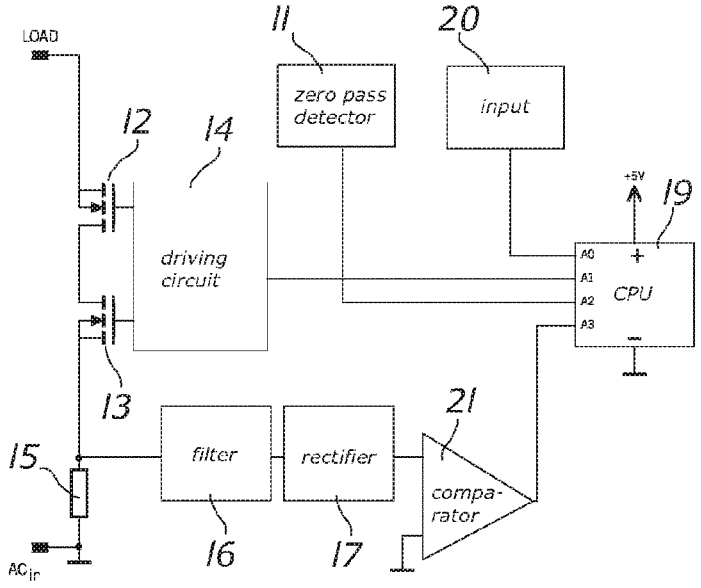
FIG. 13 illustrates another simplification of the circuit and processing algorithm; and, FIG. 14 illustrates yet another simplification of the circuit and processing algorithm.

Another simplification of the method is depicted on FIG. 13. The conditioned load current signal, having passed through the filter 16 and the rectifier 17, is fed to a comparator 21 where it is compared with a value near zero. If the load current is positive, the output of the comparator is "1" and the comparator 21 output is "0" otherwise. This significantly simplifies the circuitry since no amplification control for best performance is needed. But on the other hand, some information contained in the load current signal is lost.

Figure 14:
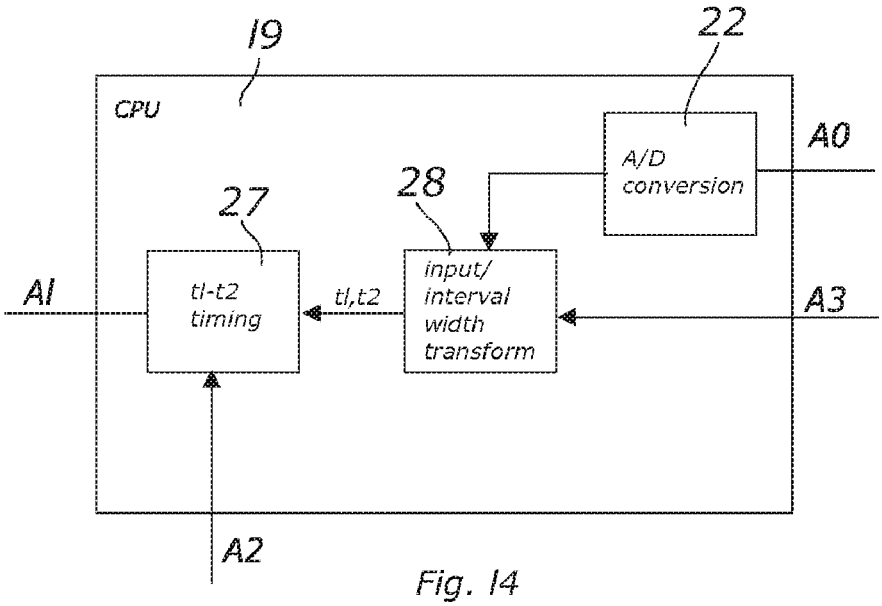

The simplified processing algorithm is depicted in FIG. 14. The input signal is connected to pin A0. If the signal is analog, it is converted to a digital value in the A/D converter (22). If the input signal is digital, the A/D converter 22 can be omitted or by-passed. The digital input value is then transformed directly to t1,t2 and t3,t4 interval widths. To adapt to different loads, the transformation is based on load properties derived from the load current time distribution, contained in the output signal from the comparator 21.

While preferred embodiments of the present invention have been shown and described, it will be understood by those skilled in the art that various changes or modifications are possible without varying from the scope of the present invention.

The invention claimed is:

1. An universal dimmer for adjusting an output from a load regardless of whether the load is a linear type load or a non-linear type load using an AC power control method incorporating phase angle control comprising:

a switching element to effect switching of AC line power on and off delivered to the load;

a load current measurement element for measuring a current passing through the load;

means for evaluating parameters of current passing through the load; and, a firing angle adjustment element, which is a regulator, wherein the firing angle adjustment element is responsive to the measured current and evaluated parameters of the load current for determining at which phase angle in an AC period the load is connected to AC power and at which phase angle the load is disconnected from AC power, and adjusting firing angles of the switching element in such way that a load RMS current is adapted to be proportional to an input signal, regardless of the type of load being controlled.

2. The dimmer of claim 1 wherein the regulator sets a start and an end firing angle for each half period in such a way that the load current is proportional to the input signal value.

3. The dimmer of claim 1 wherein the load current evaluation determines the current RMS.

4. The dimmer of claim 1 where the firing angles are identical for both half periods.

5. The dimmer of claim 1 wherein the evaluating means determines a load current time distribution.

6. The dimmer of claim 5 further comprising means for transforming the input signal value to the firing angle for each half period, based on the load current time distribution, such that the load current is proportional to the input signal value.

7. The dimmer of claim 1 wherein the firing angle adjustment element is a transforming element which transforms the input values to corresponding firing angles directly.

8. The dimmer of claim 7 wherein the transformation is based on measured load current time distribution.

9. The dimmer of claim 6 wherein the firing angles are identical for both half periods.

10. An universal dimmer for adjusting an output from a load regardless of whether the load is a linear type load or a non-linear type load using an AC power control method incorporating phase angle control comprising:

a switching element to effect switching of AC line power on and off delivered to the load;

a load current measurement element for measuring a current passing through the load;

means for evaluating parameters of current passing through the load, the means for evaluating the load current used to determine a measured load current distribution; and, a transforming element for transforming input values to corresponding firing angles based on the measured load current distribution by determining at which phase angle in an AC period the load is connected to the AC power and at which phase angle the load is disconnected from the AC power, in such way that a load RMS current is adapted to be proportional to an input signal, regardless of the type of load being controlled.

11. A method for adjusting an output from a load regardless of whether the load is a linear type load or a non-linear type load loads in response to a selected input signal, using an AC power control method incorporating phase angle control comprising:

providing a switching element to effect switching of AC line power on and off delivered to the load;

measuring a current passing through the load;

evaluating parameters of the current passing through the load; and, using a measurement of the load and the evaluated parameters of the load current, to determine at which phase angle in an AC period the load is connected to AC power and at which phase angle the load is disconnected from AC power, thereby adjusting firing angles of the switching element in such way that the load current is made to be proportional to an input signal, regardless of the type of load being controlled.

12. The method of claim 11 further comprising setting a start and an end firing angle for each half period in such a way that the load current is proportional to the input signal value.

13. The method of claim 11 wherein the load current evaluation determines a current RMS.

14. The method of claim 11 where the firing angles are identical for both half periods.

15. The method of claim 11 wherein the evaluating means determines a load current time distribution.

16. The dimmer of claim 15 further comprising transforming the input signal value to a firing angle for each half period, based on the load current time distribution, such that the load current is adapted to be proportional to the input signal value.

17. The method of claim 11 further comprising providing a transforming element for transforming the input values to corresponding firing angles directly.

18. The method of claim 17 wherein the transformation is based on measured load current time distribution.

19. The method of claim 16 wherein the firing angles are identical for both half periods.

* * * * *